United States Patent [19]

Kirby

[11] 4,276,227

[45] Jun. 30, 1981

[54] METHOD OF TREATING EDIBLE OIL WITH ALKALI USING INTERFACIAL SURFACE MIXER

[75] Inventor: Charles E. Kirby, Cincinnati, Ohio

[73] Assignee: The Procter & Gamble Company, Cincinnati, Ohio

[21] Appl. No.: 128,053

[22] Filed: Mar. 7, 1980

[51] Int. Cl.[3] ..... C11B 3/06

[52] U.S. Cl. ..... 260/425

[58] Field of Search ..... 260/425

[56] References Cited

U.S. PATENT DOCUMENTS

| | | | |
|---|---|---|---|
| 2,230,796 | 2/1941 | Froding | 260/425 |
| 2,412,251 | 12/1946 | Clayton | 260/425 |
| 2,564,407 | 8/1951 | Parkin | 260/425 |
| 2,678,936 | 5/1954 | Afzelius | 260/425 |
| 2,686,796 | 8/1954 | Markley | 260/425 |
| 3,943,155 | 3/1976 | Young | 260/425 |
| 4,035,402 | 7/1977 | Levine | 260/425 |

OTHER PUBLICATIONS

Design Bulletin "Static Mixer Modules" Kenics Corp. (1973) pp. 1-6.

*Primary Examiner*—John F. Niebling

*Attorney, Agent, or Firm*—Leonard Williamson; Eric W. Guttag; Richard C. Witte

[57] ABSTRACT

A method of treating edible oil comprising:

driving a stream of about 70 to about 99.9 wt. % of an edible oil and about 0.1 to about 30 wt. % of a 0.01 to 6.5 Normal aqueous alkali solution, through an interfacial surface mixer at a predetermined mean droplet diameter of the aqueous alkali (phase) in said stream, which is related to a predetermined Reynolds number, said stream having a mixing temperature of from about 3° C. to about 60° C., and thereby mixing and reacting said oil and said alkali to provide a reacted aqueous alkali phase and a reacted oil phase, and then separating said reacted oil from said reacted aqueous alkali.

The residence mixing and reacting time of the oil and alkali stream in the mixer is about five seconds: thus, the method of this invention is faster and more efficient than corresponding prior art oil alkali treatment processes. Neutral oil loss is reduced up to 80% and mixing energy required is reduced up to 98% over corresponding prior art.

The predetermined alkaline solution phase droplet size generated in the mixer is calculated to be small enough to react with the oil and thereby provide the desired results, i.e., the refining of crude oil, the dewaxing of refined oil or the combined refining and dewaxing of crude oil. The droplet should however not be so small so as to generate an emulsion.

25 Claims, No Drawings

METHOD OF TREATING EDIBLE OIL WITH ALKALI USING INTERFACIAL SURFACE MIXER

TECHNICAL FIELD

This invention relates to the art of treating edible oil with alkali to provide refined oil from crude, dewaxed oil from refined oil, and refined and dewaxed oil from crude oil.

BACKGROUND OF THE INVENTION

The art of treating edible oil with alkali has heretofore been carried out in slurry tanks using gentle agitation with residence times of from 3 to 40 minutes. These extended residence or contact times were believed to be necessary to accomplish the desired dewaxing of refined oil or refining of crude oil. E.g., U.S. Pat. No. 3,943,155 to Young, Mar. 9, 1976, discloses a process for refining and dewaxing crude vegetable oils using only one separation step which removes both the hydrophilic and waxy components from the crude oil. Aqueous alkali is agitated with the crude oil in a "crystallizer tank" at a temperature of from about 15° F. to about 45° F. for 15–40 minutes to form an emulsion. The emulsion is broken by mixing it with phosphoric acid. U.S. Pat. No. 4,035,402 to Levine, July 12, 1977, discloses a process for effectively dewaxing vegetable oils which comprises: chilling a refined and water-washed or filtered vegetable oil, mixing the chilled vegetable oil with a dilute alkaline solution, gently agitating the resulting mixture in a low shear, high circular manner for at least 30 minutes, centrifuging the mixture and separating a heavy phase which contains wax and other impurities from a light oil phase.

In general, crude vegetable glyceride oils, as they are obtained from their natural sources by conventional extraction methods, normally contain various nonglyceride impurities. These nonglyceride substances include gross material from the source of fat, such as xanthophyll or chlorophyll; products obtained by the breakdown of the glyceride during treatment, such as free fatty acids; and other derivatives of the glycerides, such as phosphatides and sterols. In addition, many vegetable oils normally contain natural waxes. Some of these above-mentioned impurities are desirable in that they help to protect the oil from oxidation or other adverse processes, but by far the greater amount of these substances must be removed during processing for edible purposes because they are deleterious to the appearance, taste, keeping qualities, and other properties of the oil. Refining and winterizing or dewaxing operations have, thus, become commonly employed to effect the removal of these impurities. As used herein treating edible oil with alkali includes reacting the alkali with these impurities to remove them.

The removal of gross impurities, gummy or mucilaginous material, and the free fatty acids from the glyceride oil is commonly referred to as "refining" and as used herein the term includes refining and bleaching or refining as these terms are used in the trade. In a typical refining operation, undesirable impurities are preferentially combined with a refining agent to form hydrophilic components. These are subsequently removed from the oil by a separation of aqueous and oil phases. Known methods of refining include contacting the glyceride oil with strong or dilute alkaline materials followed by separation of impurities, by liquid-liquid extraction of impurities from the glyceride oils, by steam distillation, and by contacting the glyceride oils with acids. Each of these methods is said to have its advantages for use in refining oil of one type or another for a certain ultimate utility by removing to a greater or lesser extent the hydrophilic component of the oils.

However, these known refining methods do not remove all of the impurities from the vegetable oil, and in particular, waxy components tend to remain in such oils. For example, if the refined vegetable oils are cooled to a temperature of about 4° C., the higher melting triglycerides and any vegetable waxes (linear esters) present will crystallize and either impart a cloudy appearance to the oil or settle out as a crystalline precipitate. When the oil is again raised to room temperature, the crystallized waxes may or may not redissolve in the oil. Thus, the oil at room temperature may or may not regain its clarity depending upon the amount of the respective impurities contained in it. Thus, without further processing, any such vegetable oil containing these higher melting triglycerides or vegetable waxes is not suitable for certain purposes where the clarity of the oil at low temperatures is important.

For example, oils which are suitable for salad oil use frequently are stored in refrigerators. The prolonged cooling of such oils to temperatures normally encountered in refrigerators, such as from about −1° C. to about 10° C., requires a product which retains its clarity if it is to be desirable to the consumer.

The ultimate objective of a refining, dewaxing or a combined operation is to remove every undesirable impurity completely, while at the same time maintaining intact all of the desirable glyceride oil. The particular process used with a given oil is determined by the foregoing considerations of maximum impurity removal with the minimum of glyceride oil loss. Since a good part of the refining cost arises from losses of glyceride oil, much work has been done to increase the efficiency of refining and dewaxing operations, and many processes have been developed for this purpose. The majority of the refining processes developed employ temperatures of at least room temperature and often higher to obtain a complete removal of the hydrophilic impurities and to minimize oil losses. Refining processes, of course, do not accomplish removal of all of the free fatty acids or all of the waxy components, which are inseparable from the glyceride component at these higher temperatures.

Thus, a separate low-temperature dewaxing step is necessary to remove the waxy components. Since there are oil losses inherent in the separation steps which usually follow the refining and dewaxing operations, methods which embody multiple separation steps tend to be uneconomical. Low-temperature refining methods have been attempted to simultaneously remove the hydrophilic and waxy components from the crude oil. However, the methods developed thus far have not been entirely satisfactory. At low temperatures, a virtually inseparable emulsion tends to be formed from a vegetable oil and an aqueous refining agent. This results either in extraordinarily high oil refining losses or an incomplete removal of the impurities, the latter of which results in a cloudy oil at low temperatures.

Today, much of the glyceride oil is refined in a continuous process. This process involves the steps of bringing the oil and alkali to an elevated temperature, mixing these two materials, adjusting the temperature, if necessary, providing a sufficient hold time, and continuously separating the refined glyceride oil from the impurities by centrifugation. Thereafter, if dewaxing is necessary, the refined oil is cooled to a low temperature to crystallize the waxy components. These are then removed by either a slow filtration or a second aqueous separation step performed on the cooled oil.

U.S. Pat. No. 3,704,006 to Grout et al., granted Nov. 28, 1972 relates to a method for producing a dispersion of a dispersed phase in a continuous phase field in which the dispersed phase is immiscible. The method is performed in a system which includes a conduit containing a plurality of sheet-like elements extending longitudinally within the conduit. Each element is curved to turn the direction of fluid flowing past it. The elements are arranged in alternating right- and left-handed curvature groups (a group consisting of one or more elements). The two phases are injected into the conduit and pumped through it at predetermined velocity, which together with the density of the continuous phase, the interfacial tension between the phases and the inner diameter of the conduit determines the Weber number. It is taught that the drop production reaches an equilibrium between break up and coalescence at about twelve elements and is well stabilized at 21 elements. It is taught that the system and method can be used to extract solvents, remove color from or clarify liquids, remove or add heat, or affect mass transfer rates in reactions. Acidic or alkaline solutions to be combined with organic liquids are mentioned. It may completely oxidize a contaminant in an effluent, or for example, by dispersing an oxygen containing gas in water in which is dissolved $NA_2SO_3$. Tests on various hydrocarbons dispersed in water are reported.

Grout et al. does not, however, teach treating edible oils with aqueous alkali solutions in processes comprising dewaxing refined oils, refining crude oils or combined refining and dewaxing crude oils. It remained for the present inventor to bring those processes to light within the context of treating edible oil with aqueous alkali using an interactive surface mixer.

In view of the above, it is an object of this invention to provide an improved method of treating edible oil with an aqueous alkali solution to provide an easily separable mixture of a reacted aqueous alkali phase and a reacted oil phase.

Another object of the present invention is to reduce neutral oil loss in processing edible oil with an aqueous alkali solution.

SUMMARY OF THE INVENTION

A method of treating edible oil comprising:

driving a stream of about 70 to about 99.9 wt. % of an edible oil and about 0.1 to about 30 wt. % of an 0.01 to 6.5 Normal aqueous alkali solution, through an interfacial surface mixer at a predetermined mean droplet diameter of the aqueous alkali (phase) in said stream, which is related to a predetermined Reynolds number said stream having a temperature of from about 3° C. to about 60° C., and thereby mixing and reacting said oil and said alkali to provide a reacted aqueous alkali phase and a reacted oil phase, and then separating said reacted oil from said reacted aqueous alkali.

The predetermined alkaline solution phase droplet size generated in the mixer is calculated to be small enough to react with the oil and thereby provide the desired results, i.e, the refining of crude oil, the dewaxing of refined oil or the combined refining and dewaxing of crude oil. The droplet should however not be so small so as to generate an emulsion.

DESCRIPTIONS OF PREFERRED EMBODIMENTS

The method of the present invention treating edible oil comprising:

driving a stream of about 70 to about 99.9 wt. % of an edible oil and about 0.1 to about 30 wt. % of an 0.01 to 6.5 Normal aqueous alkali solution, through an interactive surface mixer to generate a predetermined droplet size related to a predetermined Reynolds number, said stream having a temperature of from about 3° C. to about 60° C., and thereby mixing and reacting said oil and said alkali to provide a reacted aqueous alkali phase and a reacted oil phase, and then separating said reacted oil from said reacted aqueous alkali.

A preferred method comprises driving the stream of oil and alkali through an interactive surface mixer which comprises a conduit containing a number of series-connected static mixing elements, each element stratifying the stream flow and each succeeding element further stratifying said stream flow, resulting in an exponential increase in the stratification of said stream resulting in thorough static mixing. This type of mixer is described and claimed in the U.S. Patent to Armeniades et al., U.S. Pat. No. 3,286,992, Nov. 22, 1966, herein incorporated by reference in its entirety. U.S. Patent to Grout et al., U.S. Pat. No. 3,704,006 also describes a mixer of this type and is incorporated herein in its entirety. These types of interactive surface mixers can comprise from about 6 to about 30 helical static mixing elements enclosed within a pipe. The elements are juxtaposed at 90° to each other to affect said stratification, radial flow and static mixing.

The terms static mixing, interactive surface mixing, and interfacial surface mixing and their related terms as used herein are synonymous.

Alternative interactive surface mixers are useful in the practice of the present invention. One alternative interactive surface mixer comprises a conduit containing a number of series-connected static mixing elements, each of said elements having a stratifying region to stratify the stream flow, each of said elements also having a connecting throughput region of turbulent flow mixing independent of said stratified mixing. This type of mixer is described and claimed in a U.S. patent to Harder, U.S. Pat. No. 3,583,678, June 8, 1971, incorporated herein in its entirety. U.S. Pat. No. 3,860,217 to Grout discloses a similar mixer of this type; this patent is also incorporated herein in its entirety.

These patents are incorporated herein to provide references to suitable mixers and systems useful in the practice of the present invention.

An interactive surface mixer is defined herein as an inline mixing device with no moving parts. The device is installed between an oil holding tank and a separation device. The device is internally equipped with special non-moving static mixing element assemblies for flow division of stratification.

Preferred mixing is accomplished by flow division and radial mixing. Chen, S. J. and MacDonald, A. R., "Motionless Mixers for Viscous Materials", Chem. Eng., Vol. 80, No. 7, pp. 105–110, 1973; Chen, S. J., "A New Inline, Continuous Concept in Mixing and Processing of Plastics", a paper presented at 1973 ANTEC of SPE, Montreal, May 7–10, 1973. This type of static mixing is disclosed in detail in U.S. Pat. No. 3,286,992, to Armeniades et al, Nov. 22, 1966; No. 3,664,638 to Grout, May 23, 1972; and No. 3,704,006 to Grout, Nov. 28, 1972, all of which are incorporated herein by reference in their entirety. "STATIC MIXER" is a registered trademark of Kenics Corporation, North Andover, Massachusetts.

Other types of interactive surface mixing devices which use different mixing mechanisms are useful in the practice of this invention. E.g., a static mixing device which consists of a number of chambers having two or more inlets and two or more outlets, the inlets and outlets being non-coplanar and the planes intersecting an axis of flow. A number of such static mixing elements are series-connected to provide a mixer which divides flow and creates layers within a stream and the mixing or layering action is independent of throughput below the region of turbulent flow. U.S. Pat. No. 3,404,869 to Harder, Oct. 8, 1968 and No. 3,583,678 to Harder, June 8, 1971; these patents are also incorporated herein by reference in their entirety.

The method of the present invention is used to treat oils which contain less than about 0.005 wt. % wax. A vegetable oil selected from the group consisting of soybean, palm, peanut, cotton seed and coconut oil can be driven through the static mixing device at a temperature of from about 23° C. to about 60° C. with good results.

The method of the present invention is particularly useful for dewaxing a wax-containing refined oil wherein the stream driven through the mixer comprises from about 5 wt. % to about 30 wt. % of a 0.01 to 0.5 Normal alkali solution and wherein said method comprises the steps of:

(a) tempering said refining oil at a temperature of from about 20° C. to about 50° C. for at least about 12 hours using gentle agitation;

(b) cooling the tempered oil of step (a) to a temperature of below about 20° C. for at least about 1 hour using gentle agitation; and then (c) driving a stream of the cooled oil of step (b) and said alkali solution at a temperature of below about 20° C. through said interactive surface mixer to provide a reacted aqueous alkali wax-containing phase and a reacted oil phase, and (d) separating said phases at a temperature of below about 20° C. into a dewaxed oil phase and a reacted wax-containing aqueous alkali phase.

The method of dewaxing a refined oil preferably comprises treating the oil with from about 10 wt. % to about 25 wt. % of a 0.05 to 0.25 Normal alkali solution. The wax-containing refined oil in step (a) is tempered and held at a temperature from about 23° C. to about 40° C. for at least 24 hours and then in step (b) cooled and held at a temperature of from about 3° C. to about 16° C. for at least about 3 hours. Step (c) preferably comprises driving the stream refined oil and aqueous alkali through the interactive surface mixer at a temperature of below about 16° C. Step (d) of the method preferably comprises separating said phases at a temperature of below about 16° C.

Refined vegetable oil typically has a wax content of from about 0.01 wt. % to about 0.05 wt. % and a free fatty acid content of from about 0.05 to about 0.10 wt. % and some have a wax content of from 0.01 to about 0.04 wt. % and must be dewaxed for refrigerator clarity stability.

If the oil being mixed and reacted is a crude vegetable seed oil it will be composed of mixtures of many naturally produced chemical compounds, including not only the oily constituents but also, usually, small percentages of natural phosphatides, vegetable waxes, pigments, and many other compounds. The oily constituents, namely, the glyceride esters of the long chain fatty acid of the saturated and unsaturated types, make up the largest fraction of vegetable oils. The latter materials to a large extent determine the properties of the oil, but the remaining constituents also exert a marked and sometimes detrimental effect, depending upon the use to which the oil is put.

The method of the present invention can be used for refining a crude wax-containing edible oil wherein the stream of oil and alkali driven through the mixer comprises from about 0.1 wt. % to about 6 wt. % of a 3.5 to 6.5 Normal alkali solution, and wherein said method comprises the steps of:

(a) tempering said crude oil at a temperature of from about 23° C. to about 50° C. for at least about 24 hours using gentle agitation: then (b) cooling and holding said tempered crude oil at a temperature of from about 3° C. to about 21° C. for at least about another 5 hours using gentle agitation;

(c) heating said cooled oil to a maximum temperature of about 38° C.; and then (d) driving a stream comprising the oil of step (c) and said aqueous alkali solution through said interactive surface mixer to provide said reacted aqueous alkali phase and a reacted oil phase;

(e) heating the mixture of step (d) to a maximum temperature of about 60° C. and separating said reacted oil phase from said aqueous phase to provide a refined oil.

The crude oil and alkali stream driven through the mixer preferably comprises from about 0.25 wt. % to about 2.5 wt. % of 4.0 to 5.5 Normal alkali solution.

The temperature of step (a) in the method of refining crude oil preferably is 23° C. to about 40° C., and step (b) comprises cooling and holding the tempered crude oil for at least 12 hours at a temperature of from about 3° C. to about 16° C. Step (d) preferably comprises driving the stream through said interactive surface mixer at a temperature of from about 23° C. to about 32° C. Step (e) preferably comprises heating the reaction mixture to a temperature of from about 27° C. to about 50° C. and then separating the reacted oil phase from the aqueous alkali phase to provide a refined oil.

Edible crude oil typically has a wax content of from about 0.05 to about 0.5 wt. %. Some crude oils have a free fatty acid content of from about 0.1 to about 10 wt. %. But the preferred edible crude oil treated by the method of this invention has a free fatty acid content of less than 2.5 wt. %, and the stream is driven through said static mixing device at a temperature of from about 23° C. to about 32° C.

Another preferred method of this invention comprises refining and dewaxing a crude wax-containing oil with from about 0.1 wt. % to about 6 wt. % of a 2.5 to 6 Normal alkali solution. This method comprises the steps of:

(a) tempering the crude oil at a temperature of from about 23° C. to about 50° C. for at least about 24 hours using gentle agitation; then (b) cooling and holding said tempered crude oil at a temperature of from about 3° C. to about 21° C. for at least about another 5 hours using gentle agitation;

(c) driving a stream of the cooled oil of step (b) and said alkali solution through said interactive surface mixer at a mixing temperature of no higher than about 21° C. to provide a reacted aqueous alkali phase and a reacted oil phase; and (d) separating said oil phase from said reacted aqueous alkali phase at a temperature of no higher than about 21° C.

The preferred embodiments of this method include using from about 0.25 wt. % to about 5 wt. % of a 3.0 to 5.5 Normal alkali solution; a temperature in step (a) of about 23° C. to about 40° C., and wherein step (b) comprises holding the oil for at least 12 hours at 3° C. to about 16° C. The stream of step (c) is preferably maintained at a temperature of from about 3° C. to about 16° C.

The reacted oil and alkali phases are preferably separated at a temperature below about 16° C.

The refined and dewaxed crude oil can have a wax content of from about 0.05 to about 0.5 wt. % and a free fatty acid content of less than about 2.5 wt. %.

The aqueous alkali solution is preferably a mixture of sodium hydroxide and sodium carbonate, but can be simply a sodium hydroxide solution.

The preferred edible oil is selected from the group consisting of safflower, sunflower and corn oil. The most preferred edible oil is sunflower seed oil which is very difficult to dewax.

Suitable aqueous alkali solutions for purposes of this invention include, but are not limited to sodium hydroxide, sodium bicarbonate, sodium carbonate, calcium hydroxide, potassium hydroxide, magnesium hydroxide, ammonia, and some organic alkalis. Any of a variety of alkaline materials can be used for this purpose. A preferred alkaline material is sodium hydroxide, although others are viable substitutes.

Examples of suitable organic alkaline compounds include the water-soluble soaps of fatty acids such as the alkali metal (e.g. sodium or potassium), ammonium or substituted ammonium (e.g. alkanol-amine) salts of saturated or unsaturated fatty acids. The employment of an aqueous solution of a soap material constitutes an alternative practice from the standpoints of desirable cold test results and neutral oil losses. Since the formation of soap by reaction of alkali such as sodium hydroxide and neutral oil is minimized by addition of a soap material, losses of neutral oil are avoided. Thus, addition of soap in contrast to an in situ formation of soap constitutes a preferred practice. Soaps of fatty acids of from 8 to 22 carbon atoms, and preferably from 12 to 18 carbon atoms, are suitable. Preferably the soap materials will be soaps of fatty acids corresponding in chain length to the acyl groups of the glyceride oils treated in accordance with the invention. Thus, soaps of sunflower, safflower or corn oil fatty acids can be employed although soaps of tallow fatty acids, coconut fatty acids and other fatty acids of like edible fats can be suitably employed. Alkali metal soaps of oleic acid, e.g. sodium or potassium oleate, are preferred and provide desirable wax removal results combined with minimal oil losses.

It will be appreciated that solutions of other alkali agents can be suitably employed although they will be used in different amounts or concentrations depending upon solubility, stoichiometry and nature of the particular alkali employed and the oil being treated.

The Reynolds numbers of Examples I, II and III relate to aqueous mean droplet sizes small enough to provide the desired reactions and wax transfers, but are not so small so as to generate emulsions. The Reynolds number can be adjusted to provide a desired droplet size.

If an emulsion is created, an emulsion breaking agent, e.g. a phosphoric acid solution can be mixed into the reaction mixture to possibly promote phase separation. Emulsions, however, are to be avoided because they complicate rapid phase separation.

EXAMPLE I

Dewaxing of Refined Vegetable Oil

A batch of refined and bleached sunflower oil having a wax level of about 150 ppm and a free fatty acid content of less than 0.1% was cooled to 35° C. and held for about 72 hours to allow the oil to temper. After the oil had tempered, the oil was cooled to 4° C. and held for 3 more hours. Following the 3 hours at 4° C., a lye (NaOH) solution at a normality of about 0.1 was added to the refined and bleached oil at a level of about 18% on a total stream weight basis. The oil and aqueous alkali solution were injected into a conduit and driven as a stream at about 4° C. through an interactive surface mixer at a Reynolds Number of about 240 and a Weber Number of about 3040 where the oil and aqueous phases were contacted and mixed. The interactive surface mixer comprised a 2 inch pipe and contained 24 helical mixing elements juxtaposed at 90° to each other, resulting in a calculated mean Sauter droplet diameter of 720 microns for the aqueous alkali phase. The mixer was maufactured by the Kinecs Corporation, North Andover, Mass. 01845, and is of the type described in their U.S. Pat. Nos. 3,286,992, supra, and 3,704,006, supra, which are incorporated herein by reference in their entireties.

The mixing and reacting was effected by the interactive surface mixer in about 5 seconds versus the 30 minutes or more required in conventional paddle mixing, as disclosed in the U.S. Pat. No. 4,035,402 to Levine, July, 1977. This resulted in about an 80% reduction in neutral oil loss versus the paddle mixing process disclosed and claimed in the U.S. Pat. No. 4,035,402 to Levine, herein incorporated by reference in its entirety.

The reaction mixture was then separated in a centrifuge at about 4° C. where the reacted oil phase was separated from the reacted aqueous alkali phase. This resulted in a refined and dewaxed oil having the following analyses:

| Centrifuge Feed Composition % Soap/% $H_2O$ | Centrifuge Exit Dewaxed Oil Composition % Soap/% $H_2O$ | Wax Analysis Total ppm | Cold Test 0°/4° C. Hrs |
|---|---|---|---|
| 1.48%/17.7% | .080%/ <1.0% | 51 | >24/ <15 |
| 1.19%/19.3% | .040%/ <1.0% | 22 | >24/ >24 |
| 1.13%/18.0% | .054%/ <1.0% | 48 | >24/ >24 |
| 0.89%/17.8% | .031%/ <1.0% | 27 | >24 >24 |
| 0.57%/15.7% | .032%/ <1.0% | 29 | >24/ >24 |
| 0.15%/15.5% | .021%/ <1.0% | 24 | >24/ >24 |

EXAMPLE II

Crude Oil to Refined Oil

A batch of crude sunflower oil having a wax level of about 900 ppm and a free fatty acid (FFA) content of about 0.7% is cooled to 25° C. and held for over 24 hours to allow the oil to temper. After the 24 hour minimum time at 25° C., the oil is cooled to 10° C. and held for at least another 12 hours. Following that 12 hour period, the oil is heated to 29° C. using a heat exchanger. Following heating, aqueous solutions of (1) soda ash ($Na_2CO_3$) and (2) lye (NaOH) at normalities of 4.0 and 5.4 respectively are added to the crude oil at a total level of about 2.0% on a weight basis. The oil and aqueous phases form a stream which is then driven through an interactive surface mixer at about 29° C. at a Reynolds Number of about 1470 and a Weber Number of about 8130 where the crude oil and aqueous alkali phases are contacted and desired reactions are affected. The interactive surface mixer comprises a 4 inch pipe containing 12 helical mixing elements juxtaposed at 90° to each other and results in an aqueous alkali Sauter mean droplet diameter of about 720 microns. The interactive surface mixer is manufactured by the Kenics Corporation, North Andover, Mass. 01845, and is of the same type used in Example I.

The mixing and reacting are effected by the interactive surface mixer in about 3.5 seconds versus about 8 minutes required in conventional methods which use paddle mixers.

The now mixed and reacted oil and aqueous alkali is sent on to centrifugal separation at about 48° C. During centrifugal separation the reacted oil phase is separated from the aqueous alkali phase resulting in an oil having the following analysis:

| Refined Oil Analysis | |
|---|---|
| % Soap | = 0.1% |
| % FFA | = 0.05% |
| ppm phospholipids | = <10 |
| ppm wax | = 150 |

EXAMPLE III

Combined Refining and Dewaxing

A batch of crude sunflower oil having a wax level of about 900 ppm and a free fatty acid content of about 0.7% is cooled to 25° C. and held for at least 24 hours to allow the oil to temper. After the 24 hour minimum time at 25° C., the oil is cooled to 4° C. and held for at least 12 more hours. Following that 12 hour period, cooled aqueous alkali solutions comprising (1) soda ash ($Na_2CO_3$) and (2) lye (NaOH) at normalities of about 3.0 and 4.0 respectively are added to the cooled crude oil at a level of about 2.5% on a weight basis to provide a stream. The oil and aqueous alkali are then injected into a conduit and driven through an interactive surface mixer at a Reynolds Number of about 560 and a Weber Number of about 8130 where the crude oil and aqueous alkali phases are contacted and desired reactions are affected. The interactive surface mixer comprises a 4 inch pipe and contains 18 helical mixing elements juxtaposed at 90° to each other and results in a Sauter mean droplet diameter of about 720 microns for the aqueous alkali phase. The mixer is the same type used in Examples I and II.

The mixing and reacting are effected by the interactive surface mixer in about 6 seconds versus the minutes required in a conventional paddle mixer as that described in the U.S. Pat. No. 3,943,155 to Young.

The now mixed and reacted oil and reacted aqueous alkali is sent to centrifugal separation at about 4° C. During centrifugal separation, the reacted oil phase is separated from the aqueous alkali phase resulting in an oil having the following analysis:

| Refined and Dewaxed Oil Analysis | |
|---|---|
| % Soap | = 0.2% |
| % FFA | = 0.1% |
| ppm phospholipids | = < 15 |
| ppm waxes | = 35 |
| 0° C. cold test | = > 24 hours |

What is claimed is:

1. A method for refining, dewaxing or combined refining and dewaxing an impurity-containing edible oil, said method comprising the steps of:
   (a) forming a stream of from about 70 to about 99.9 wt. % of an impurity-containing edible oil and from about 0.1 to about 30 wt. % of a 0.01 to 6.5 Normal aqueous alkali solution;
   (b) driving the stream through an interfacial surface mixer at a temperature of from about 3° C. to about 60° C. so as to generate a mean droplet size in the alkali solution sufficiently small to mix with the oil, and to react with and remove the impurities therein, without forming an emulsion; and
   (c) separating the purified oil from the alkali solution after step (b).

2. A method according to claim 1 wherein step (b) comprises driving the stream through the interfacial surface mixer at a temperature of from about 23° C. to about 60° C.

3. A method according to claim 2 wherein the alkali solution comprises sodium hydroxide.

4. A method according to claim 1 wherein the edible oil is selected from the group consisting of safflower oil, soybean oil, palm oil, corn oil, peanut oil, cottonseed oil, coconut oil and sunflower oil.

5. A method according to claim 1 wherein the edible oil comprises sunflower oil.

6. A method for dewaxing a wax-containing refined edible oil which has been tempered at a temperature of from about 20° C. to about 50° C. for at least about 12 hours, and then cooled to below about 20° C. for at least about 1 hour, said method comprising the steps of:
   (a) forming a stream of from about 70 to about 95 wt. % cooled oil and from about 5 to about 30 wt. % of a 0.01 to 0.5 Normal aqueous alkali solution;
   (b) driving the stream through an interfacial surface mixer at a temperature below about 20° C. so as to generate a mean droplet size in the alkali solution sufficiently small to mix with the oil, and to react with and remove the waxes therein, without forming an emulsion; and
   (c) separating the dewaxed oil from the alkali solution at a temperature below about 20° C. after step (b).

7. A method according to claim 6 wherein step (b) comprises driving the stream through the interfacial surface mixer at a temperature below about 16° C.

8. A method according to claim 7 wherein step (c) comprises separating the refined oil from the alkali solution at a temperature below about 16° C.

9. A method according to claim 8 wherein the stream comprises from about 10 to about 25 wt. % of a 0.05 to 0.25 Normal sodium hydroxide solution.

10. A method according to claim 8 wherein the refined oil has been tempered at a temperature of from about 23° C. to about 40° C. for at least about 24 hours and then cooled to a temperature of from about 3° C. to about 16° C. for at least about 3 hours.

11. A method according to claim 6 wherein the refined oil is selected from the group consisting of safflower oil, corn oil and sunflower oil.

12. A method according to claim 6 wherein the refined oil comprises sunflower oil.

13. A method for refining a wax-containing crude edible oil which has been tempered at a temperature of from about 23° C. to about 50° C. for at least about 24 hours and then cooled to a temperature of from about 3° C. to about 21° C. for at least about 5 hours, said method comprising the steps of:

(a) forming a stream of from about 94 to about 99.9 wt. % cooled oil and from about 0.1 to about 6 wt. % of a 3.5 to 6.5 Normal aqueous alkali solution;

(b) driving the stream through an interfacial surface mixer at a maximum temperature of about 38° C. so as to generate a mean droplet size in the alkali solution sufficiently small to mix with the oil, and to react with and remove the waxes therein, without forming an emulsion; and (c) heating the refined oil and alkali solution after step (b) to a temperature of from about 27° C. to about 60° C.;

(d) separating the refined oil from the alkali solution after step (c).

14. A method according to claim 13 wherein step (b) comprises driving the stream through the interfacial surface mixer at a temperature of from about 23° C. to about 32° C.

15. A method according to claim 14 wherein the stream comprises from about 0.25 to about 2.5 wt. % of 4.0 to 5.5 Normal sodium hydroxide solution.

16. A method according to claim 14 wherein the crude oil has been tempered at a temperature of from about 23° C. to about 40° C., and then cooled to a temperature of from about 3° C. to about 16° C. for at least about 12 hours.

17. A method according to claim 13 wherein the crude oil is selected from the group consisting of safflower oil, corn oil and sunflower oil.

18. A method according to claim 13 wherein the edible oil comprises sunflower oil.

19. A method for refining and dewaxing a crude wax-containing edible oil which has been tempered at a temperature of from about 23° C. to about 50° C. for at least about 24 hours and then cooled to a temperature of from about 3° C. to about 21° C. for at least about 5 hours, said method comprising the steps of:

(a) forming a stream of from about 94 to about 99.9 wt. % cooled oil and from about 0.1 to about 6 wt. % of a 2.5 to 6 Normal aqueous alkali solution;

(b) driving the stream through an interfacial surface mixer at a temperature no higher than about 21° C. so as to generate a mean droplet size in the alkali solution sufficiently small to mix with the oil, and to react with and remove the waxes therein, without forming an emulsion; and (c) separating the refined and dewaxed oil from the alkali solution at a temperature no higher than about 21° C. after step (b).

20. A method according to claim 19 wherein step (b) comprises driving the stream through the interfacial surface mixer at a temperature of from about 3° C. to about 16° C.

21. A method according to claim 20 wherein step (c) comprises separating the refined and dewaxed oil from the alkali solution at a temperature below about 16° C.

22. A method according to claim 21 wherein the stream comprises from about 0.25 to about 5 wt. % of a 3.0 to 5.5 Normal sodium hydroxide solution.

23. A method according to claim 21 wherein the crude oil has been tempered at a temperature of from about 23° C. to about 40° C., and then cooled to a temperature of from about 3° C. to about 16° C. for at least about 12 hours.

24. A method according to claim 19 wherein the crude oil is selected from the group consisting of safflower oil, corn oil and sunflower oil.

25. A method according to claim 19 wherein the edible oil comprises sunflower oil.

* * * * *